US005240013A

United States Patent [19]

Johnson et al.

[11] Patent Number: 5,240,013

[45] Date of Patent: Aug. 31, 1993

[54] RELATING TO SLICED BALE CONDITIONING

[75] Inventors: Ralph W. Johnson, Andover; Roger L. Simmens, Lyndhurst; Thomas H. White, Winchester, all of United Kingdom

[73] Assignee: W. H. Dickinson Engineering Limited, Hampshire, United Kingdom

[21] Appl. No.: 735,785

[22] Filed: Jul. 25, 1991

[30] Foreign Application Priority Data

May 13, 1991 [EP] European Pat. Off. ..... 91304268.5

[51] Int. Cl.[5] ..... A24B 3/07

[52] U.S. Cl. ..... 131/290; 131/319; 414/785; 241/101.7

[58] Field of Search ..... 131/290, 311, 319, 322; 414/796.7, 796.8, 785; 241/101.7; 225/93; 83/931; 37/120; 294/120, 126

[56] References Cited

U.S. PATENT DOCUMENTS

| | | | |
|---|---|---|---|
| 1,065,748 | 6/1913 | Vollers | 37/120 |
| 2,612,280 | 9/1952 | Stueland | 37/120 X |
| 4,297,073 | 10/1981 | Schmid et al. | 241/101.7 X |
| 4,514,127 | 4/1985 | Maier | 414/785 X |
| 4,674,786 | 6/1987 | Lynch | 294/120 |
| 4,988,264 | 1/1991 | Winski et al. | 414/796.8 X |
| 5,017,085 | 5/1991 | Ishikawa | 414/796.8 X |
| 5,033,684 | 7/1991 | von der Heide | 241/101.7 |

FOREIGN PATENT DOCUMENTS

| | | | |
|---|---|---|---|
| 0101271 | 2/1984 | European Pat. Off. . | |
| 3925668 | 2/1991 | Fed. Rep. of Germany | 414/785 |
| 8702868 | 5/1987 | PCT Int'l Appl. | 131/118 |
| 159836 | 2/1985 | United Kingdom . | |

*Primary Examiner*—V. Millin
*Assistant Examiner*—J. Doyle
*Attorney, Agent, or Firm*—Fay, Sharpe, Beall, Fagan, Minnich & McKee

[57] ABSTRACT

Apparatus for slicing tobacco bales comprising a plurality of parallel sharp prongs or lances (1) which can be moved to penetrate the bale (7) in a horizontal plane while the bale is supported on a lift device (14). A retractable pusher (9) is arranged to be movable parallel to the prongs so as to separate the slice from them after cutting and has downwardly dependent sharpened teeth (10) attached to its lower edge so as to extend between the prongs.

13 Claims, 1 Drawing Sheet

RELATING TO SLICED BALE CONDITIONING

This invention relates to apparatus for slicing tobacco bales and feeding them to a processing device. One example of such an apparatus is shown in our European Patent No. 01 59 836, in which sliced portions of tobacco bales are mechanically transferred from a slicer blade to a conditioning station by means of a pusher device.

In a typical device of this kind, one or more blades or forks forming a slicer are pushed into the bale in a horizontal direction so as to cleave it along a horizontal plane between the layers of tobacco.

When processing certain types of tobacco material it is difficult to ensure that the material is consistently cleaved along the desired plane.

This may be due to poor orientation of the layers within a bale, or to local variations in the packing density throughout the bale.

The effect of these variations in tobacco density and orientation is such that the forks do not separate slices cleanly from the bale, and in extreme cases, sufficient material is displaced by the forks so as to either impede their forward movement, or to prevent the slice from being separated from the bale in the subsequent pushing operation.

Accordingly, the present invention provides apparatus for slicing tobacco bales characterised by a plurality of parallel prongs or lances, and means for moving the prongs so as to penetrate the bale parallel to the layers of tobacco in the bale.

Preferably the pusher device comprises a reciprocatable abutment device which is mounted so as to be movable parallel to the lances to enable a slice to be freed from the lances after cutting.

Preferably the lances have a regular cross-section which is stepped along its length, the outer ends being pointed to penetrate the bale.

Preferably the lances are equi-spaced from one another in the same horizontal plane, and the abutment device in the same horizontal plane, and the abutment device comprises a blade or ram which extends in a plane perpendicular to the direction of the lances.

Preferably the bale slicer assembly also includes a lift device for raising the base to successive positions in which it can be offered up to the slicer means, so as to enable a series of slices to be cut from it.

One embodiment of the invention will now be described by way of example with reference to the accompanying drawings in which.

Figure 1:
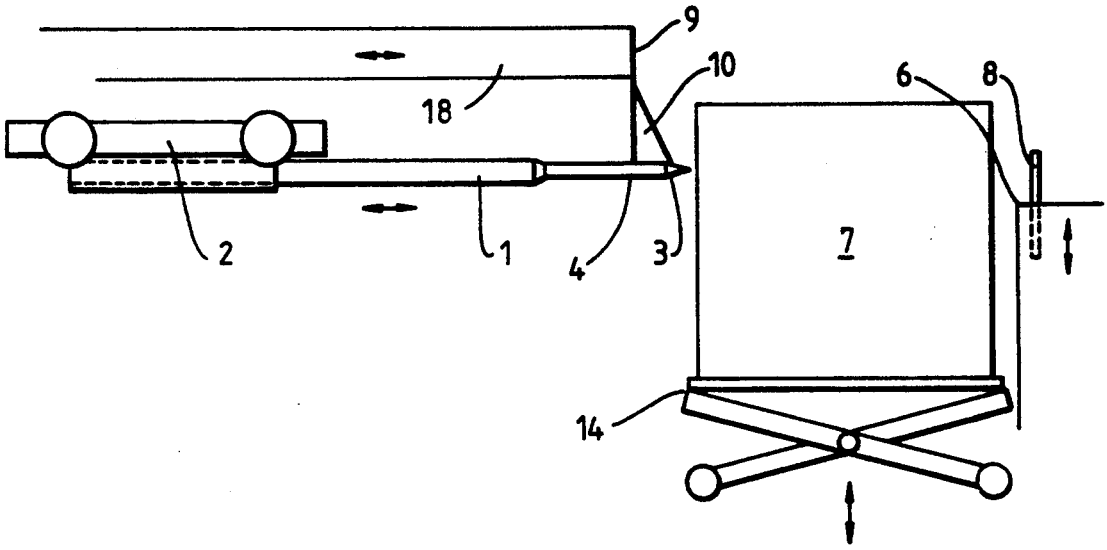
FIG. 1 is a schematic elevational view of a bale slicer including a lance assembly in accordance with the invention.
Figure 2:
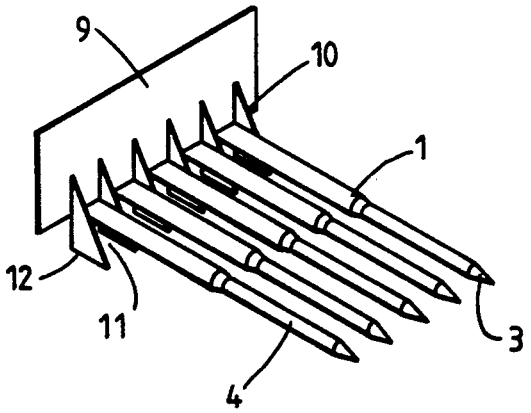
FIG. 2 is a perspective view of the lance assembly of FIG. 1.

Referring to the drawings, the slicer comprises a row of lances or probes 1 which are arranged parallel to one another in a horizontal plane and which are mounted on a carriage 2 which is movable in the horizontal direction by means of suitable actuators which may for example be electrical, mechanical, pneumatic or hydraulic. Each lance has a pointed end 3, so as to penetrate the bale with the minimum force and disruption of the layers, with an adjacent section 4 which has a circular cross-section with a diameter of approximately 15 to 25 mm for a distance corresponding to about one third of the bale length in the direction of slicing. After a short tapering section the diameter increases to between 25 and 100 mm, preferably about 60 mm. Instead of a circular profile, of course the lance may be of another suitable cross-section.

In order to assist in the cleaving action, an abutment 6 forming a shear edge is positioned behind the lift position, slightly below the cutting plane, and a retractable or removable stop 8 is arranged to support the cut slice above the cutting plane. As will be appreciated from the drawing the stop 8 is set back somewhat from the shear edge.

The retractable stop as shown comprises a series of rod-like members which can be raised or lowered through apertures in the surface behind the shear edge 6, so that the cut slice can be moved away from the slicer, after cutting, for example to be conveyed to a conditioner.

A pusher 9 is also provided to remove the cut slice from the slicer, and as shown this comprises a flat blade forming a ram with an actuator 18 which is arranged to move it in the same direction as the slicer. The blade also incorporates downwardly extending teeth 10 attached to its front face, spaced apart so that they extend down between the lances 1, which have sharpened leading edges 11 and underside edges 12, so that if portions of the tobacco bale become wedged at the shear edge, the combined action of the sharpened teeth and the pusher blade will break them up without impeding forward movement of the pusher.

We claim:

1. Apparatus for slicing tobacco bales comprising:
- a plurality of parallel prongs;
- means for moving the prongs so as to penetrate a tobacco bale parallel to a plurality of layers of tobacco in the bale; and,
- a pusher device for separating a cut slice from the prongs after slicing, the pusher device comprising:
- an actuator mounted for reciprocal movement parallel to and adjacent to said prongs,
- a ram carried by said actuator and having a front face which engages with the bale, and
  - a plurality of downwardly depending teeth which are secured to and extend perpendicular to the front face of the ram and into the spaces between the prongs.

2. Apparatus according to claim 1 in which said teeth have sharpened forward facing edges.

3. Apparatus according to claim 1 in which said teeth have sharpened underneath edges.

4. Apparatus according to claim 1 in which the prongs each have an inner end, a sharpened outer end and a progressively decreasing cross-section along its length from the inner end to the outer end.

5. Apparatus according to claim 4 in which said cross-section is stepped.

6. Apparatus according to claim 1 further comprising a lift device adapted to raise the bale in a series of steps whereby a series of slices can be successively cut from the top of the bale.

7. Apparatus according to claim 6 further comprising retractable abutment means arranged on the opposite side of the lift from the slicer means, whereby the top of the bale is urged against the abutment means during slicing and abutment means can then be retracted to allow passage of the slice away from the lift.

8. Apparatus for slicing tobacco bales comprising:
- a plurality of parallel prongs, each having an inner end and an outer end;

means for moving the prongs so as to penetrate a tobacco bale parallel to the layers of tobacco in the bale, each prong having a cross-section which is stepped down from the inner end to the outer end, and wherein the outer end is sharpened;

a pusher device for separating a cut slice from said prongs after slicing; and, actuator means for moving said pusher device parallel to said prongs.

9. Apparatus according to claim 8 in which the step comprises a short tapered section.

10. Apparatus according to claim 8 wherein said pusher device comprises:

a ram having a face that engages the bale; and a plurality of teeth which are secured to said face, said teeth extending in a plane perpendicular to a plane of said face.

11. Apparatus according to claim 10 wherein said teeth each include a sharpened edge.

12. Apparatus according to claim 10 wherein said plurality of teeth are substantially equally spaced along said face.

13. Apparatus according to claim 10 wherein said plurality of teeth are secured to said face at a lower edge thereof such that a portion of each tooth extends past said lower edge.

* * * * *